US005821018A

United States Patent [19]

Ohtsu et al.

[11] Patent Number: 5,821,018

[45] Date of Patent: Oct. 13, 1998

[54] IMAGE FORMING MEMBER AND IMAGE FORMING PROCESS

[75] Inventors: Shigemi Ohtsu; Makoto Furuki; Lyong Sun Pu, all of Ashigarakami-gun, Japan

[73] Assignee: Fuji Xerox Co., Ltd., Tokyo, Japan

[21] Appl. No.: 707,709

[22] Filed: Sep. 4, 1996

[30] Foreign Application Priority Data

Sep. 5, 1995 [JP] Japan ..... 7-228318

[51] Int. Cl.[6] ..... G03C 13/00

[52] U.S. Cl. ..... 430/31; 430/48; 430/49; 430/346; 430/945

[58] Field of Search ..... 430/31, 48, 49, 430/346, 945

[56] References Cited

U.S. PATENT DOCUMENTS

| | | | |
|---|---|---|---|
| 3,853,556 | 12/1974 | Severynse . | |
| 4,032,226 | 6/1977 | Groner . | |
| 4,130,359 | 12/1978 | Groner . | |
| 4,247,613 | 1/1981 | Off . | |
| 4,308,332 | 12/1981 | Upson et al. . | |
| 5,382,486 | 1/1995 | Yu et al. . | |
| 5,589,307 | 12/1996 | Takeuchi | 430/49 |

FOREIGN PATENT DOCUMENTS

| | | |
|---|---|---|
| A-435-592 | 7/1991 | European Pat. Off. . |
| A-616-261 | 9/1994 | European Pat. Off. . |
| A-2-142835 | 5/1990 | Japan . |
| A-2 000 324 | 1/1979 | United Kingdom . |

OTHER PUBLICATIONS

J. Chem. Soc. Chem. Commun., 1986, "Ion–Sieving of Electrosynthesized Polypyrrole Films", Hiroaki Shinohara et al., pp. 87–88.

J. Electrochem. Soc., vol. 132, No. 10, Oct. 1985, "Photoelectrochromic Properties of Polypyrrole–Coated Silicon Electrodes", Hiroshi Yoneyama et al., pp. 2414–2417.

Reactive Polymers, 6 (1987), "Functionalized Conducting Polymers for Development of New Polymeric Reagents", Takeo Shimidzu, pp. 221–227.

Shinohara et al., *Journal of the Society of Chemistry of Japan*, No. 3, p. 465, 1986.

Abstract of JP 7–084337 (Mar. 1995).

Abstract of JP–2–142835 (May 1990).

*Primary Examiner*—John A. McPherson

*Attorney, Agent, or Firm*—Oliff & Berridge, PLC

[57] ABSTRACT

A conducting polymer film comprising a substrate comprising a semiconductor having thereon a conducting polymer film capable of being doped with or undoped of an ionic dye molecule. In the image forming process of the present invention, the conducting polymer film is irradiated with light to generate electromotive force so that the conducting polymer film is doped with or undoped of an ionic dye molecule according to the electromotive force to form an image pattern thereon. The ionic dye molecule forming the image pattern is electrochemically released, and then transferred to a recording medium such as paper. The image forming process provides images of good quality at a relatively high printing speed. The image forming process is energy-saving and takes a low running cost. An marking process and marking apparatus using the above image forming process are also disclosed.

19 Claims, 5 Drawing Sheets

IMAGE FORMING MEMBER AND IMAGE FORMING PROCESS

FIELD OF THE INVENTION

The present invention relates to an image forming member for forming an image on a conducting polymer film formed on an organic or inorganic semiconductor substrate, a process for forming an image by the image forming member, and a marking process and apparatus for transferring an image to a recording medium by the medium of a conducting polymer film. The image forming film, image forming process, and marking process and apparatus of the present invention are applied to printing or copying machines such as color printers.

BACKGROUND OF THE INVENTION

Examples of the process which is employed at present in printing devices such as a printer as a process for transferring an image to a recording medium such as paper according to an electrical signal or optical signal include dot impact process, heat transfer process, heat sublimation process, ink jet process, and electrophotographic process as used in a laser printer. These processes are roughly divided into three categories.

Processes belonging to the first category include dot impact process, heat transfer process, and heat sublimation process. These processes comprise placing a sheet having a dye molecule dispersed therein, e.g., an ink ribbon and a donor film over paper and transferring the dye to the paper by dynamic impact or heat. Thus, these processes always require some expendables and the printing speed thereof can hardly be increased. Furthermore, these processes are performed at a low energy efficiency and at a high running cost. These processes except heat sublimation process provide products with a poor quality.

On the other hand, the ink jet process belonging to the second category comprises transferring an ink directly from the head to the paper and thus requires no expendables but ink, and is carried out at a low running cost. However, the ink jet process is disadvantageous in that it is difficult to electrically control all dots and to form a head having the same width as that of the paper so that it is difficult to perform the process at a high speed. The ink jet process is also disadvantageous in that the smallest allowable image unit is defined by the size of the head or the head gap. Therefore, with respect to the ink jet process, the higher the print quality is, the lower the printing speed and the energy efficiency is.

Furthermore, in the electrophotographic process as used in a laser printer belonging to the third category, an image is formed by the medium of an intermediate transfer material. In the electrophotographic process, an electrostatic latent image formed by a spotted laser light on a photoreceptor adsorbs toner which is then transferred to paper to form an image thereon. Thus, the electrophotographic process can form a relatively fine image. Further, the electrophotographic process consumes only toner and thus is performed at a low running cost. However, the electrophotographic process is disadvantageous in that it requires a high voltage to form an electrostatic latent image and to adsorb and transfer a toner, and thus consumes a great power, resulting in the generation of ozone or nitrogen oxides. Further, any of the above-described printing processes generate a relatively large operating noise.

On the other hand, image formation processes such as printing, silver halide photography, etc. can give an image with a good quality. However, printing needs a plate so that it is not suitable to ordinary uses instead of a low running cost where a large number of the same image are formed. On the other hand, silver halide photography requires the use of nonrecyclable mediums such as photographic film and photographic paper so that it takes a high running cost and it is also difficult to increase the image-forming speed.

As a method for solving the foregoing problems, it is proposed that a medium be employed which forms and transfers or directly transfers and forms an image distribution formed by an image forming element such as toner and ink reflecting the object on the same scale as the object to be transferred (same as a paper width). The medium acts as a primary retainer for the image forming element. It is demanded that the incorporation and release (exchange) of the medium be carried out at a relatively low energy with a continuous gradation. It is further demanded that the unit size of the image forming element be diminished.

Examples of the medium having such a capacity include conducting polymer films such as polypyrrole film, polythiophene film and polyaniline film. It is known that these polymer films are capable of being controlled chemically, electrically or electrochemically to be in a state of the oxidized state, the neutral state or the reduced state. The transition between the states accompanies with doping with or undoping of counter ions. These characteristics are further described in Susumu Yoshimura, "Conducting Polymer", The Society of Polymer Science, Japan, 1987; Kazuo Yamashita and Akira Kitani, "Function and Design of Organic Conducting Thin Film", The Society of Surface Science, Japan, pp. 89 to 107, 1988; and Katsumi Yoshino, "Fundamentals and Applications of Conducting Polymer", IPC, 1988.

If the dopant for the doping and undoping of a conducting polymer film is a dye molecule, it can be expected that the ion may satisfactorily play a role of the medium as a temporary retainer for an image forming element that meets the foregoing requirements. However, it is known that an anion or cation of an ordinary metal or a small-molecule electrolyte is generally used as a counter ion with which a conducting polymer is doped or of which a conducting polymer is undoped and that if a conducting polymer is synthesized in the presence of a polymer anion, for example, the resulting conducting polymer film cannot be undoped of the anion.

Hiroaki Shinohara et al. discloses in *J. Chem. Soc., Chem, Commun.,* page 87, 1986 that the size of ions which can be reversibly doped or undoped is determined by the microstructure of a conducting polymer film and the microstructure can be controlled by adjusting the size of counter ions which are present together with the a monomer during the polymerization. However, this paper discloses that the ions studied therein have a molecular weight of at most about 100, and the higher the molecular weight of the ions is, the lower the doping/undoping properties of the ions are. An example of a molecule having a relatively large size which can be reversibly doped and undoped is glutamic acid in Shonohara et al, *Journal of the Society of Chemistry of Japan*, No. 3, page 465, 1986. However, even glutamic acid has a molecular weight of not more than 150. Most ordinary dye molecules have a molecular weight of from 500 to 1,500. It has never been considered that a dye molecule having a molecular weight on this order can be reversibly doped and undoped.

Conducting polymer films have been studied focusing on the application to a protective film for a battery or a solar battery and an electrochromic display element, etc., by the use of doping or undoping of a conducting polymer film with a small-molecule ion and color change accompanied with the doping or undoping. On the other hand, an example of the use of a conducting polymer film as a material for marking is "Method for controlling the wettability of the surface of a polymer thin film and an image formation method and image forming material using same" in JP-A-2-142835 (The term "JP-A" as used herein means an "unexamined published Japanese patent application"). However, this technique controls wettability of the conducting polymer film by electrically switching the state of the conducting polymer film between the oxidized state and the neutral state to form a printing plate. Accordingly, in this technique, incorporation of a dye in the conducting polymer film by doping process is not occurred so that the adsorption amount or transferred amount of a dye such as ink cannot be controlled at all.

SUMMARY OF THE INVENTION

A first object of the present invention is to provide an image forming member comprising a conducting polymer film having the foregoing properties such as a high printing quality, a relatively high printing speed and a low running cost, and being energy-saving, resource-saving, environmentally friendly and user-friendly.

A second object of the present invention is to provide a process for forming an image using the image forming member.

A third object of the present invention is to provide a marking process and apparatus for marking by the image formation process.

The inventors made studies of the above described problems paying their attention to the behavior of the ionic dye molecule in the conducting polymer film. As a result, the present invention has been achieved based on the above described findings. The foregoing first object of the present invention can be accomplished with an image forming member comprising a substrate comprising an organic or inorganic semiconductor and a conducting polymer film on the substrate, which is capable of being doped with or undoped of an ionic dye molecule.

The above second object of the present invention can be accomplished by an image forming process, which comprises irradiating a substrate comprising an organic or inorganic semiconductor with light to generate an electromotive force so that a conducting polymer film formed on the substrate is doped with or undoped of an ionic dye molecule to form an image thereon.

The above third object of the present invention can be accomplished by a marking process and apparatus, which process comprises undoping a conducting polymer film having an image pattern thereon of an ionic dye molecule, the conducting polymer film being developed by doping the conducting polymer film with an ionic dye molecule and then transferring the released ionic dye molecule to a recording medium.

The present invention is accomplished by using a conducting film which is capable of electrochemically changing its state between at least two of the three states, i.e., the oxidized state, the neutral state and the reduced state and is incorporated an ionic dye molecule therein at one of its state or a conducting polymer film which is capable of electrochemically changing its state between at least two of the above states and is prepared by polymerizing a monomer in the presence of ions having a high molecular weight, forming an image by the doping or undoping of the conducting polymer film with or of an ionic dye molecule, then undoping the doped conducting polymer film by bringing the image into contact with a transfer medium to transfer the incorporated ionic dye molecule to the transfer medium.

The image forming member of the present invention comprises a conducting polymer film which is capable of being doped with or undoped of an ionic dye molecule and is formed on a substrate comprising an organic or inorganic semiconductor.

The image forming process of the present invention comprises irradiating a substrate comprising an organic semiconductor or inorganic semiconductor with light to generate a photovoltaic force or photoelectric current therein so that a conducting polymer film formed on the substrate is doped with or undoped of an ionic dye molecule to form an image thereon.

In the image forming process, the quantity of electric charge during the image forming is controlled to form an ionic dye-doped or ionic dye-undoped zone and hence a desired image. The quantity of electric charge can be controlled by adjusting the intensity of light, the irradiated amount (or time) of light, the applied bias voltage or the thickness of conducting polymer film.

The marking process of the present invention comprises undoping an image pattern formed by doping a conducting polymer film with an ionic dye molecule to transfer the released ionic dye molecule to a recording medium. The ionic dye molecule incorporated in the conducting polymer film is transferred to a recording medium as it is to form a desired image on the recording medium.

Pig. 8 is a sectional view of an organic semiconductor substrate used in Example 7.

Figure 9:
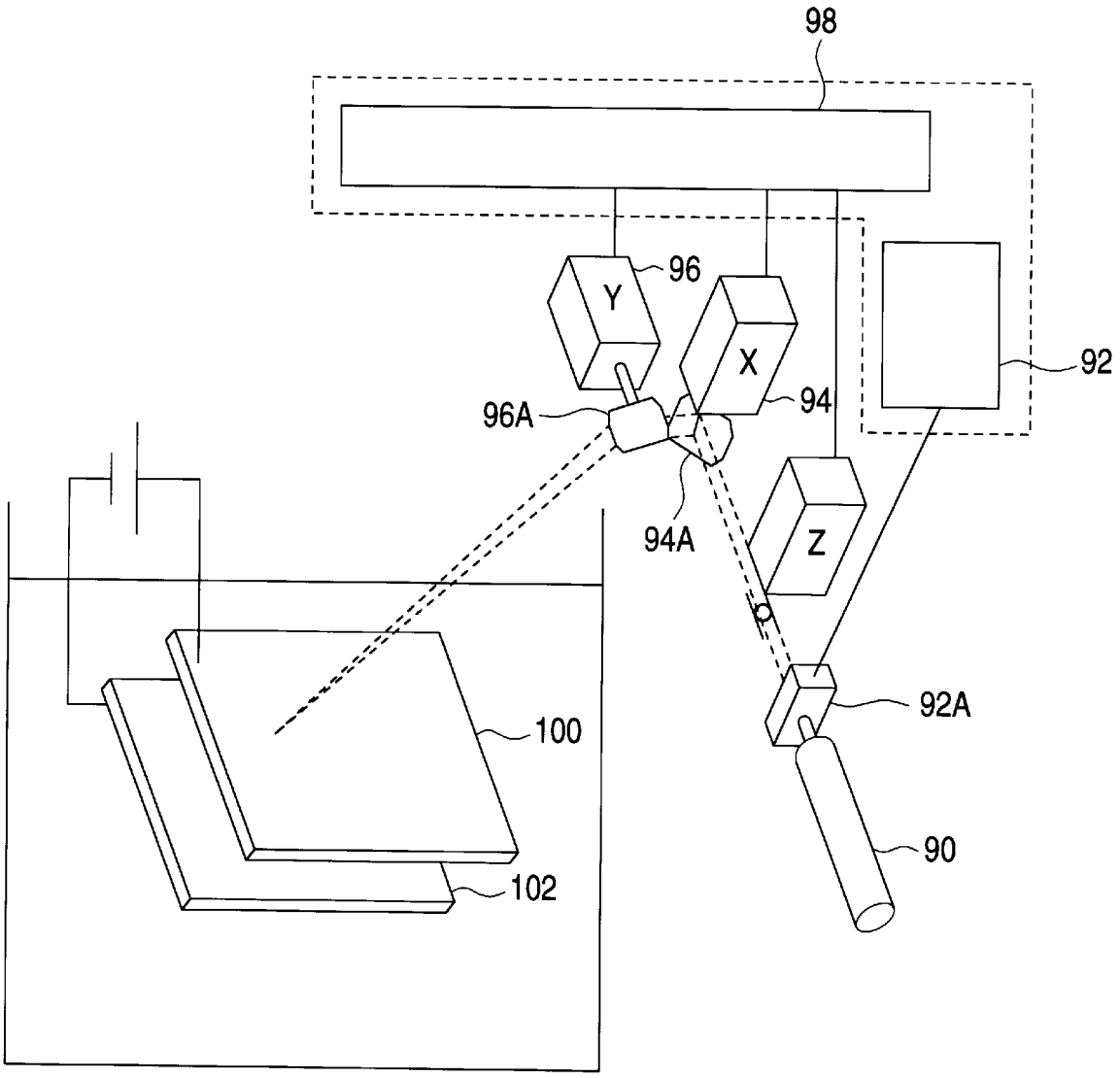

FIG. 9 is a schematic illustration of a preferred embodiment of a galvanoscanner for use in the present invention.

DETAILED DESCRIPTION OF THE INVENTION

The present invention is further described hereinafter. The conducting polymer constituting the conducting polymer film for use in the present invention may be any compound which can undergo electrochemical oxidation or reduction to be doped with or undoped of an ionic dye molecule. Examples of the conducting polymer for use in the present invention include various one-dimensional conducting polymers such as polyacetylenes, polydiacetylenes, polyheptadienes, polypyrroles, polythiophenes, polyanilines, polyphenylene vinylenes, polythiophenylene vinylenes, polyisothianephthenes, polyisonaphthothiophenes, polyparaphenylenes, polyphenylenesulfides, polyphenylene oxides, polyfurans, polyphenane seleniums, polyselenophenes, polytellurophenes, polyazlenes, polyindenes, polyindoles, polyphthalocyanines, polyacenes, polyacenoacenes, polynaphthylenes, polyanthracenes, polyperinaphthalenes, polybiphenylenes, polypyridinopyridines, polycyanodienes and polyallenemetide, ladder polymers, pyropolymers, and two-dimensional conducting polymers such as graphite.

Among these conducting polymers, polypyrroles and polyanilines are particularly preferred because they can be obtained by electrochemical polymerization at a low polymerization voltage and can be used in an aqueous system.

In order to form the foregoing conducting polymer film, electrolytic polymerization process may be employed. In some detail, a low molecular weight aromatic compound as a starting material of the conducting polymer film can be electrochemically oxidized to form a polymer film on an electrode substrate. Some aromatic halogen compounds may be subjected to electrolytic reduction polymerization to form a polymer film. According to the electrolytic polymerization process, a conducting polymer film grows with counter ions incorporated therein so as to conserve the electroneutrality during polymerization. Accordingly, if electrolytic reduction polymerization is carried out at a positive potential of the electrode, a conducting polymer film formed on the electrode substrate is in the oxidized state with an anion incorporated therein. When a negative potential is applied to the anion-doped conducting polymer film, the conducting polymer film releases the anion incorporated therein so as to conserve the electroneutrality to be in the neutral state. When the potential further turns to a negative potential, a conducting polymer film of some conducting polymers such as polythiophene becomes in the reduced state from the neutral state to be doped with a cation to conserve the electroneutrality. The cation thus incorporated is released when the potential turns to a positive potential to put the conducting polymer film in the neutral state again.

Furthermore, if the electrochemical process for the formation of a conducting polymer film is carried out in the presence of an ionic dye molecule and an ion having properties and a molecular weight comparable to those of the ionic dye molecule as coexisting ions, a conducting polymer film doped with an ionic dye molecule can be prepared. The conducting polymer film thus obtained by electrolytic polymerization can be more reversibly doped with or undoped of more ionic dye molecules than conducting polymer films prepared in the presence of other ions having a small molecular weight, accompanied with electrochemical oxidation or reduction. When the conducting polymer film is undoped of the ionic dye molecule, a voltage having a polarity opposite to that of the electrochemical doping is applied.

The present invention utilizes the foregoing properties of conducting polymer film that ions which is incorporated or released upon doping or undoping of a conducting polymer film differs depending on the state of the polymer film, i.e., the oxidized state, the neutral state and the reduced state. In other words, an anionic or cationic dye molecule is used as the anion or cation to be incorporated or released to reversibly incorporate the dye molecules into the conducting polymer film, and the dye molecule is transferred to a recording medium such as paper. The amount of ion to be incorporated in the conducting polymer film depends on the potential and time during which electric current passes, i.e., quantity of electric charge. Accordingly, by controlling the quantity of electric charge with a potential adjusted to a value exceeding a threshold, the concentration of the dye molecule in the conducting polymer film can be continuously controlled. For the process for undoping the conducting polymer film, too, by controlling the quantity of electric charge with a potential adjusted to a value exceeding a threshold, the concentration of the ionic dye molecule to be released from the conducting polymer film can be continuously controlled. Further, by providing the conducting polymer film or the electrode substrate with a potential distribution, dye ions can be limitedly incorporated in or released from the conducting polymer film so that an image with these dye ions is formed according to the potential distribution.

In electrochemical processes, platinum, which can hardly be oxidized, is often used as the electrode. However, if a metal electrode is used to form an image, it is necessary that an image pattern be previously formed or an electrode corresponding to a pixel be independently driven. Accordingly, in the present invention, a semiconductor is used to form an image pattern. The voltage required for doping or undoping is supplied in the form of photovoltaic force. Referring to the use of photovoltaic force in doping or undoping, an example of the electrochemical polymerization of pyrrole on an Si substrate is reported by Hiroshi Yoneyama et al. in *J. Electrochem. Soc.*, vol. 132, page 2414 (1985). However, these studies have focused on photoelectrochromism, and does not disclose the use of anionic or cationic dye molecule. Paying attention to anionic and cationic dye molecules, the present invention has been achieved. The present invention makes the best of the characteristics of the dye molecules in the doping or undoping of the conducting polymer film. Specifically, an image forming member and image forming process can be provided which enables a marking method in which dye molecules are only the expendables required for the formation of an image, the minimum image unit (pixel) is on the molecular scale and the density gradation is continuous. Marking is achieved by reversibly incorporating a dye into the conducting polymer film on the molecular level and releasing the dye onto a recording medium as a dye molecule density pattern.

The semiconductor for use as a substrate in the present invention may be basically any semiconductor which generates photovoltaic force when irradiated with light. Examples of the semiconductor include inorganic semiconductors such as Si, Ge, GaAs, CdSe, CdS, CdTe, InP, AlSb and GaP, and organic semiconductors such as phthalocyanines, perylene derivatives and PVK. The semiconductor of the present invention may be either n-type semiconductor or p-type semiconductor.

Examples of the foregoing perylene derivative as an organic semiconductor include (a) benzimidazole perylene in cis form, and (b) benzimidazole perylene in trans form shown below. These perylene derivatives generate a high photovoltaic force.

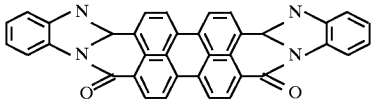

(a)

Benzimidazole perylene in cis form

-continued

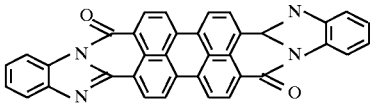

(b)

Benzimidazole perylene in trans form

The image forming member of the present invention comprises an electrode support comprising a semiconductor and a conducting polymer film capable of being doped with or undoped of an ionic dye molecule, formed on the electrode support. Examples of the process for forming such a conducting polymer film on a semiconductor electrode include electrolytic polymerization process by which a low molecular weight aromatic monomer as a starting material of a conducting polymer film is electrochemically oxidized to form a conducting polymer film on the electrode substrate.

A conducting polymer film formed by such an electrolytic polymerization process grows with counter ions incorporated therein with the electroneutrality conserved during polymerization. Accordingly, if a conducting polymer film is synthesized by electrolytic oxidative polymerization at a positive electrode potential, a conducting polymer film formed on the electrode substrate is in the oxidized state with an anion incorporated therein. When the potential turns to negative, the conducting polymer film becomes in the neutral state. Further, if the formation of a conducting polymer film is performed in the presence of a dye ion and an ion having properties and a molecular weight comparable to that of the dye ion as coexisting ions, a conducting polymer film doped with an ionic dye molecule can be prepared. The ionic dye molecule for use in the present invention may be any known dye comprising anionic or cationic dye molecules.

Examples of the ionic dye include synthetic dyes such as acridine dyes, azaphthalide dyes, azine dyes, azlenium dyes, azo dyes, azomethine dyes, aniline dyes, amidinium dyes, alizarin dyes, anthraquinone dyes, isoindolinone dyes, indigo dyes, indigoid dyes, indoaniline dyes, indolylphthalide dyes, oxazine dyes, carotinoid dyes, xanthine dyes, quinacridone dyes, quinazoline dyes, quinophthalone dyes, quinoline dyes, quinone dyes, guanidine dyes, chromium chelate dyes, chlorophyll dyes, ketoneimine dyes, diazo dyes, cyanine dyes, dioxazine dyes, disazo dyes, diphenylmethane dyes, diphenylamine dyes, squarilium dyes, spiropyrane dyes, thiazine dyes, thioindigo dyes, thiopyrilium dyes, thiofluorane dyes, triallylmethane dyes, trisazotriphenylmethane dyes, triphenylmethane dyes, triphenylmethanephthalide dyes, naphthalocyanine dyes, naphthoquinone dyes, naphthol dyes, nitroso dyes, bisazooxadiazole dyes, bisazo dyes, bisazostilbene dyes, bisazohydroxyperinone dyes, bisazofluorenone dyes, bisphenol dyes, bislactone dyes, pyralozone dyes, phenoxazine dyes, phenothiazine dyes, phthalocyanine dyes, fluorane dyes, fluorenone dyes, flugide dyes, perinone dyes, perylene dyes, benzimidazolone dyes, benzopyrane dyes, polymethine dyes, porphyrin dyes, methine dyes, melocyanine dyes, monoazo dyes, leucoauramine dyes, leucoxanthene dyes and rhodamine dyes, and natural dyes such as turmeric, Cape jasmine, Piprica, red malt, lac, grape, beet, beefsteak plant, berry, corn, cabbage and cacao. These ionic dyes should be properly selected based on the solubility of dye molecule depending on the properties of the polymer film and the environmental conditions such as a medium in which the process is carried out.

The conducting polymer film thus obtained by electrolytic polymerization can be doped with or undoped of more ionic dye molecules more reversibly than conducting polymer films prepared in the presence of other ions having a low molecular weight involved in electrochemical oxidation or reduction. The present invention is characterized by the use of photovoltaic force to dope or undope a conducting polymer film. It is preferable that the electromotive force generated by irradiation with light be enough to dope or undope a conducting polymer film. If the electromotive force is insufficient, a potential is additionally applied so that the sum of the additional potential and the electromotive force generated by irradiating with light exceed a threshold of doping or undoping the conducting polymer film.

However, since n-type semiconductor and p-type semiconductor have electrical properties opposite to each other, relation between doping and undoping is reversed. Therefore, a conducting polymer film comprising an n-type semiconductor and a conducting polymer film comprising a p-type semiconductor are applied in different manners. When a conducting polymer film comprising an n-type semiconductor is irradiated with light under the application of a bias voltage, the film is doped with an anionic dye molecule or undoped of a cationic dye molecule. When reversed vias voltage is applied to the film, the film is undoped of an anionic dye molecule or doped of a cationic dye molecule. On the contrary, when a conducting polymer film comprising a p-type semiconductor is irradiated with light under the application of a bias voltage, the film is doped with a cationic dye molecule or undoped of an anionic dye molecule.

The amount of the ionic dye molecule to be incorporated in a conducting polymer film can be controlled by the concentration of the dye molecule ion in an electrolyte solution, the potential of the conducting polymer film substrate, the amount of irradiated light, the voltage or the time during which the conducting polymer film is irradiated with light and is basically proportional to the quantity of electric charge flowing during doping. Accordingly, a conducting polymer film having a desirably controlled concentration of a dye molecule ion can be obtained by controlling the potential of the conducting polymer film substrate in an electrolyte solution containing the dye molecule ion to oxidize or reduce the conducting polymer film substrate.

In this process, if an n-type semiconductor is used as a substrate electrode, by using photovoltaic force generated by irradiating the n-type semiconductor with light, an image pattern based on an oxidative state of a conducting polymer film may be formed as a distribution of the concentration of an anionic dye molecule which is incorporated in only the light-irradiated area of the conducting polymer film in accordance with the light intensity. On the other hand, a conducting polymer film containing an anionic dye molecule ion therein is subjected to the application of a reverse voltage to that used in doping to release the anionic dye molecule ion.

If a p-type semiconductor is used as a substrate electrode, by using photovoltaic force generated by irradiating the p-type semiconductor with light, an image pattern based on an oxidative state of a conducting polymer film may be formed as a distribution of the concentration of a cationic dye molecule which is incorporated in only the light-irradiated area of the conducting polymer film in accordance with the light intensity. On the other hand, a conducting polymer film containing a cationic dye molecule ion therein is subjected to the application of a reverse voltage to that used in doping to release the cationic dye molecule ion., the conducting polymer film may be oxidized by photovoltaic force generated by a p-type semiconductor only on the area irradiated with light so that it is doped with a cationic dye molecule according to the pattern of light intensity to form an image pattern. On the contrary, a conducting polymer film comprising a cationic dye molecule ion incorporated therein may be subjected to the application of a voltage in the direction opposite that used in doping to release the cationic dye molecule ion.

Furthermore, photovoltaic force may be used for undoping. In this case, a electrochemically-polymerized conducting polymer film which is doped with an anionic or cationic dye molecule ion during the polymerization can be undoped according to the quantity of light. A conducting polymer film having a cationic dye molecule ion therein is formed on an n-type semiconductor, then by using photovoltaic force generated by irradiating the n-type semiconductor with light, an image pattern based on an oxidative state of a conducting polymer film may be obtained as a distribution of the concentration of anionic dye molecules which is incorporated in only the light-irradiated area of the conducting polymer film in accordance with the light intensity. The image pattern is transferred to perform marking.

A conducting polymer film having an anionic dye molecule ion therein is formed on an p-type semiconductor, then by using photovoltaic force generated by irradiating the p-type semiconductor with light, an image pattern based on an oxidative state of a conducting polymer film may be obtained as a distribution of the concentration of anionic dye molecules which is incorporated in only the light-irradiated area of the conducting polymer film in accordance with the light intensity. The image pattern is transferred to perform marking.

In other words, the present invention can utilize light in the polymerization of a conducting polymer film to form an image pattern having a distribution of the concentration of an ionic dye molecule incorporated according to the light intensity. Furthermore, the present invention can form an image pattern having a distribution of the concentration of an ionic dye molecule according to the light intensity during the doping of the conducting polymer film with an ionic dye molecule. Moreover, the present invention can form an image pattern having a distribution of the concentration of an ionic dye molecule released according to the light intensity during the undoping of the conducting polymer film of an Ionic dye molecule. Accordingly, in order to transfer these image patterns to a recording medium to thereby perform marking, undoping of the conducting polymer film of an anionic or cationic dye molecule may be used.

FIG. 9 shows that a preferred embodiment of the apparatus for performing optical writing by using light-irradiating means in the present invention. In FIG. 9, laser light from a laser head 90 is modulated with an acousto-optic effect optical modulator (AOM) 92A and an AOM driver 92, then the incident direction of the laser beam is adjusted along Z-axis, X-axis, and Y-axis. Each galvanodriver for X-axis 94 and Y-axis 96 is respectively controlled through a controller 98 to control the respective rotation angle of the galvanomirrors 94A and 96A, whereby the incident direction of the laser beam from the laser head 90. With the laser beam, a semiconductor 100 (n-Si substrate or a-Si substrate) opposite to the counter electrode 102 in a solution containing ionic dye molecules is irradiated so that a conducting polymer film formed on the semiconductor 100 is doped with or undoped of an ionic dye molecule.

EXAMPLE 1

Figure 1:
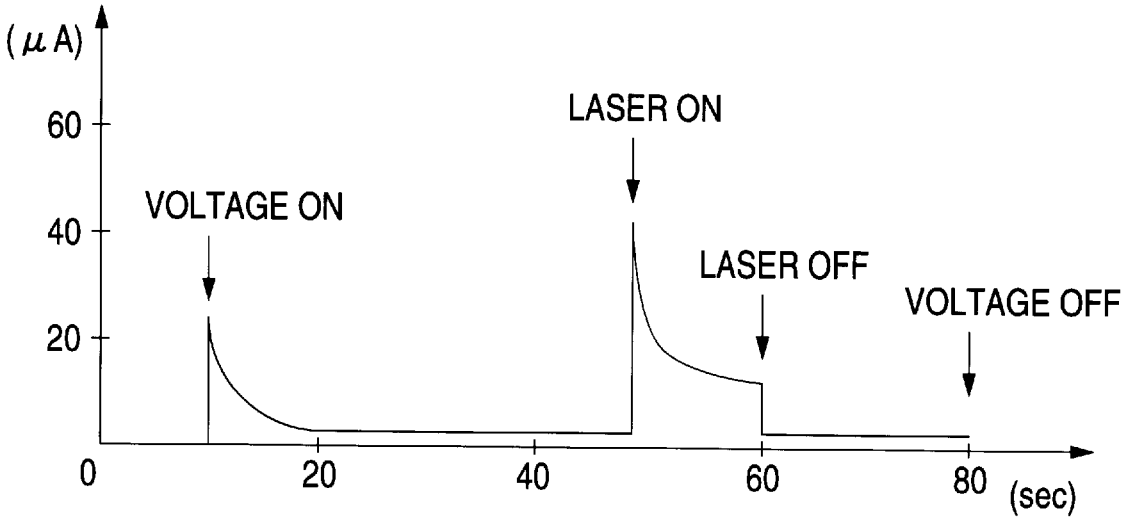
FIG. 1 is a graph illustrating the conditions of electric current in the polypyrrole film during the formation of the polypyrrole film doped with Rose Bengal on an n-Si (crystalline) substrate.

An n-Si (crystalline) substrate was subjected to ultrasonic cleaning in acetone and isopropyl alcohol, washed with water, and then dipped in buffered hydrofluoric acid to remove an oxidized film. Aluminum was then deposited onto the n-Si substrate to make ohmic contacts. The n-Si substrate was used as the working electrode in the arrangement of the three-electrode method which is commonly used in electrochemistry. When the n-Si substrate was irradiated with 3-mW He—Ne laser beam for 60 seconds in an aqueous solution containing 0.06 M of pyrrole and 0.02 M of Rose Bengal at a working electrode potential of +0.4 V vs. saturated calomel electrode, a thin polypyrrole film containing Rose Bengal was formed on the n-Si substrate. The conditions of the quantity of electric current in the n-Si substrate is shown in FIG. 1. FIG. 1 shows that when the n-Si substrate is irradiated with light, electromotive force is generated to increase the quantity of electric current. The electric current is used to synthesize polypyrrole. Since the polypyrrole thin film had been formed with Rose Bengal incorporated therein, it assumed purplish red and depth of the color increased towards the center of the film. The film had a thickness distribution corresponding to the distribution of the intensity of He—Ne laser beam. When the potential of the n-Si substrate coated with the thin polypyrrole film was set at −1.0 V in an aqueous solution containing 0.1 M of sodium chloride, the polypyrrole film was undoped of Rose Bengal to cause the thin polypyrrole film to turn royal purple. It is confirmed by this phenomenon that when the n-Si substrate is irradiated with light, a thin polypyrrole film doped with Rose Bengal and having a thickness according to the light intensity can be prepared. It is also confirmed that undoping does not require light when the applied voltage is increased.

Figure 2:
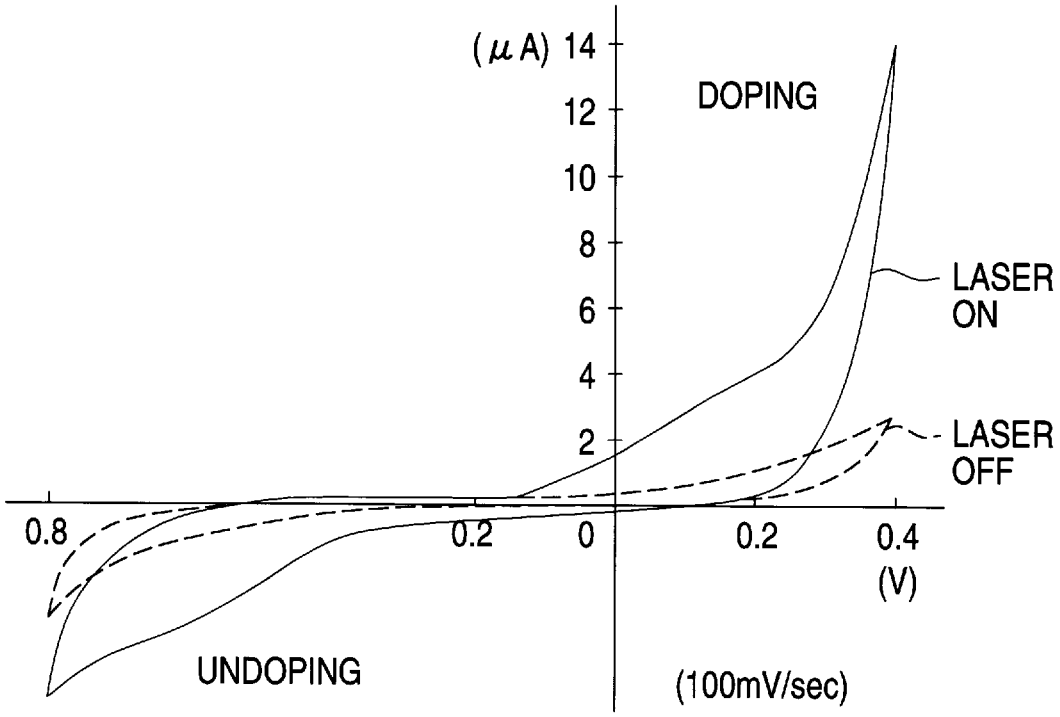
FIG. 2 is a cyclic voltammogram illustrating the behavior of doping and undoping under or without irradiation with laser beam.

Further, the n-Si substrate coated with a polypyrrole thin film was used as the working electrode in the arrangement using the three-electrode method. The potential of the film was reciprocally scanned between −0.8 V and +0.4 V vs. SCE in an aqueous solution containing only 0.02 M of Rose Bengal under or without irradiation of 3-mW He—Ne laser beam. FIG. 2 shows the cyclic voltammograms of the polypyrrole film. As seen from FIG. 2, only when the n-Si substrate was irradiated with 3-mW He—Ne laser beam, the electric current had a maximal value at −0.6 V when the applied voltage swept from positive to negative and a maximal value at +0.2 V when the applied voltage swept from negative to positive. This result shows that if the applied voltage is insufficient or no vias voltage is applied, only when the n-Si substrate is irradiated with 3-mW He—Ne laser beam, the thin polypyrrole film is undoped of or doped with Rose Bengal anion and that n-Si substrate is not doped or undoped without irradiation of light. It is thus confirmed that the polypyrrole thin film is reversibly doped with or undoped of Rose Bengal anion by irradiating the n-Si substrate with light. It is further confirmed that if the applied voltage is increased, undoping does not require light also in this case.

The n-Si substrate which had been treated in the foregoing manner to make ohmic contacts was used as working electrode in the arrangement of the three-electrode method. The film was irradiated with 3-mW He—Ne laser beam in an aqueous solution containing 0.06 M of pyrrole and 0.02 M of Rose Bengal at a working electrode potential of +0.4 V vs. SCE to write an image pattern onto the n-Si substrate. A polypyrrole thin film containing Rose Bengal dye was formed according to the image pattern.

Figure 3:
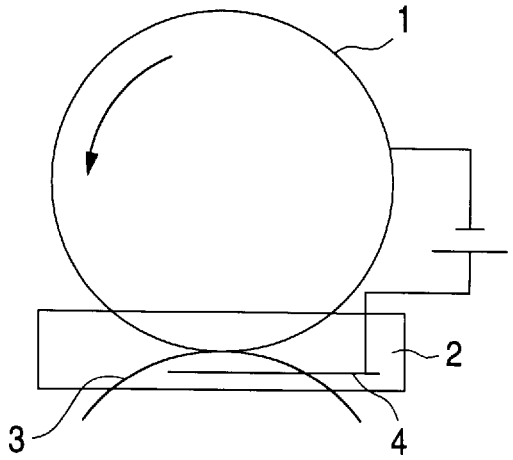
FIG. 3 is a diagram illustrating a marking process with an n-Si (crystalline) photoreceptor.

FIG. 3 shows a process for marking with an image pattern thus obtained. An n-Si (crystalline) substrate 1 having thereon a polypyrrole film on which an image pattern had been formed was used as an electrode. A sheet of paper 3 dipped in an aqueous solution 2 containing an electrolyte was then interposed between the substrate 1 and a Pt electrode 4. When the n-Si electrode 1 was set at −3 V, the Rose Bengal dye was released so that an image pattern was recorded on the paper 3.

EXAMPLE 2

A p-Si (crystalline) substrate was subjected to cleaning and deposition of Al in the same manner as in Example 1 to make ohmic contacts. The p-Si substrate was used as the working electrode in the same arrangement of the three-electrode method. When the working electrode was set at +0.8 V vs. SCE for 60 seconds in an aqueous solution containing 0.06 M of pyrrole and 0.02 M of Rose Bengal, a polypyrrole thin film containing Rose Bengal was formed on the p-Si substrate. Since the thin polypyrrole film had been formed with Rose Bengal incorporated therein, it assumed uniform purplish red. The p-Si substrate coated with a polypyrrole thin film was used as the working electrode in the arrangement of the three-electrode method. The potential of the film was repeatedly scanned between +0.4 V to −0.8 V vs. SCE an aqueous solution containing only 0.02 M of Rose Bengal under or without irradiation with 3-mW He—Ne laser beam. Only when the n-Si substrate was irradiated with 3-mW He—Ne laser beam, the electric current had a maximal value at −0.6 V when the applied voltage swept from positive to negative and a maximal value at +0.2 V when the applied voltage swept from negative to positive. This shows that only when the n-Si substrate is irradiated with 3-mW He—Ne laser beam, the polypyrrole thin film is undoped of or doped with Rose Bengal anion. It is thus confirmed that the polypyrrole thin film can be reversibly doped with or undoped of Rose Bengal anion only when the p-Si substrate is irradiated with light.

The p-Si (crystalline) substrate which had been treated in the foregoing manner to make ohmic contact was used as the working electrode. The working electrode was set at +0.8 V vs. SCE in an aqueous solution containing 0.06 M of pyrrole and 0.02 M of Rose Bengal to form a polypyrrole thin film containing a Rose Bengal dye on the entire surface of the substrate.

Figure 4:
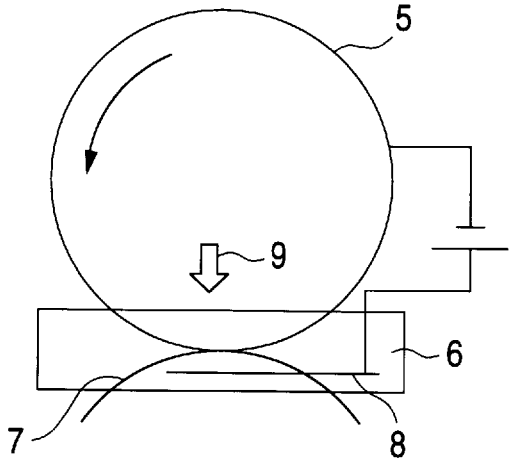
FIG. 4 is a diagram illustrating a marking process with a p-Si (crystalline) photoreceptor.

FIG. 4 shows a process for marking with this thin polypyrrole film containing a Rose Bengal dye. A p-Si substrate 5 on which a polypyrrole thin film containing Rose Bengal dye had been formed was used as an electrode. A sheet of paper 7 dipped in an aqueous solution 6 containing an electrolyte was then interposed between the substrate 5 and a Pt electrode 8. When the p-Si electrode was irradiated with 3-mW He—Ne laser 9 on the back side thereof with the potential of the p-si electrode set at −1.5 V to write an image pattern onto the polypyrrole thin film, the polypyrrole thin film was undoped of Rose Bengal so that the image pattern was recorded on the paper 7.

EXAMPLE 3

An n-Si (crystalline) substrate was subjected to cleaning and deposition of Al in the same manner as in Example 1 to make ohmic contacts. The n-Si substrate was used as the working electrode in the arrangement of the three-electrode method. When the n-Si substrate was irradiated with 3-mW He—Ne laser beam through a lens to widen the irradiation area at a working electrode potential of +0.5 V vs. SCE for 60 seconds in an aqueous solution containing 0.06 M of pyrrole and 0.02 M of Rose Bengal, a polypyrrole thin film containing Rose Bengal was formed entirely on the n-Si substrate. The n-Si substrate coated with the polypyrrole thin film was arranged as the working electrode based on the three-electrode method. The potential of the working electrode was set at −1.0 V in an aqueous solution containing 0.02 M of Rose Bengal to completely release Rose Bengal from the polypyrrole thin film. When the polypyrrole thin film thus obtained was then locally irradiated with 3-mW He—Ne laser beam with the working electrode set at +0.4 V for 60 seconds, the polypyrrole thin film was doped with Rose Bengal so that a Rose Bengal-doped spot in purplish red was formed. The spot formed by doping had a distribution of the concentration of Rose Bengal corresponding to the distribution of the intensity of He—Ne laser beam which increases towards the central portion. These results demonstrate that the n-Si substrate can be doped with Rose Bengal in a concentration distribution in accordance with the distribution of the light intensity when irradiated with light.

In the above-described manner, an image pattern was formed on a polypyrrole thin film by doping the polypyrrole film with Rose Bengal dye according to the distribution of intensity of He—Ne laser beam. A sheet of paper dipped in an aqueous solution containing an electrolyte was interposed between the n-Si substrate and a Pt electrode. When the n-Si electrode was set at −1.0 V, the Rose Bengal dye was released so that an image pattern having gradation was recorded on the paper.

EXAMPLE 4

Figure 5:
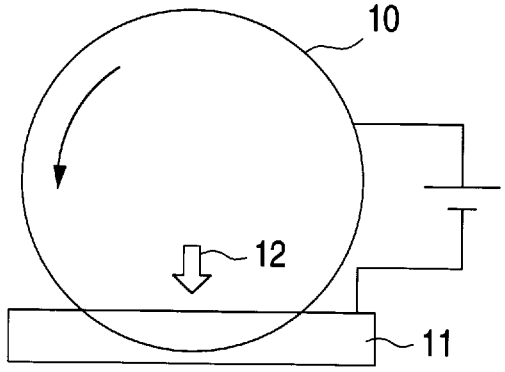
FIG. 5 Is a diagram illustrating an image forming process with an n-type a-Si (amorphous) photoreceptor.

As shown in FIG. 5, an n-type a-Si (amorphous) photoreceptor 10 was used as an electrode. The photoreceptor 10 was irradiated with He—Ne laser beam 12 while being brought into contact with an aqueous solution 11 containing 0.06 M of pyrrole and 0.02 M of Rose Bengal to form a polypyrrole thin film having an image pattern thereon. As shown in FIG. 3, the polypyrrole film having the image pattern was undoped of the Rose Bengal dye to print a good image having a gradation of density on paper.

Figure 6:
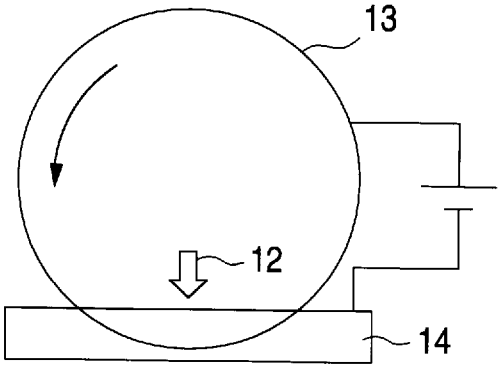
FIG. 6 is a diagram illustrating an image forming process with a p-type a-Si (amorphous) photoreceptor.

As shown in FIG. 6, a p-type a-Si (amorphous) photoreceptor 13 was used as an electrode. The photoreceptor 13 was then brought into contact with an aqueous solution 14 containing 0.06 M of pyrrole and 0.02 M of Rose Bengal and voltage was applied between the p-type a-Si (amorphous) photoreceptor 13 and the aqueous solution 14 to form a polypyrrole thin film having an image pattern thereon. As shown in FIG. 4, the polypyrrole film having the image pattern was undoped of the Rose Bengal dye to print a good image having a gradation of density on paper.

EXAMPLE 5

As in Example 3, an n-Si (crystalline) substrate was subjected to cleaning and deposition of A1 in the same manner as in Example 1 to make ohmic contacts. The n-Si substrate was used as the working electrode 17 with respect to saturated calomel electrode, and a Pt electrode 21 was used as the counter electrode in an aqueous solution 19 containing 0.06 M of pyrrole and 0.02 M of Rose Bengal in the apparatus shown in FIG. 7. The n-Si working electrode 17 was irradiated in the aqueous solution with laser beam 23 externally from a galvanoscanner as shown in FIG. 9 with the potential of the n-Si working electrode set at +0.4 V vs. SCE to write an image pattern. As a result, a polypyrrole film containing Rose Bengal was formed only on the area irradiated with light, and the polypyrrole film had thereon an image having a density gradation according to the intensity of irradiated light or irradiation time. The n-Si substrate on which the polypyrrole film having an image was formed was washed with pure water, and then brought into contact with a sheet of paper impregnated with an alkaline buffer solution having a pH value of 10. As a result, the Rose Bengal dye was attached to the paper so that an image having a density gradation was transferred to the paper.

EXAMPLE 6

Figure 7:
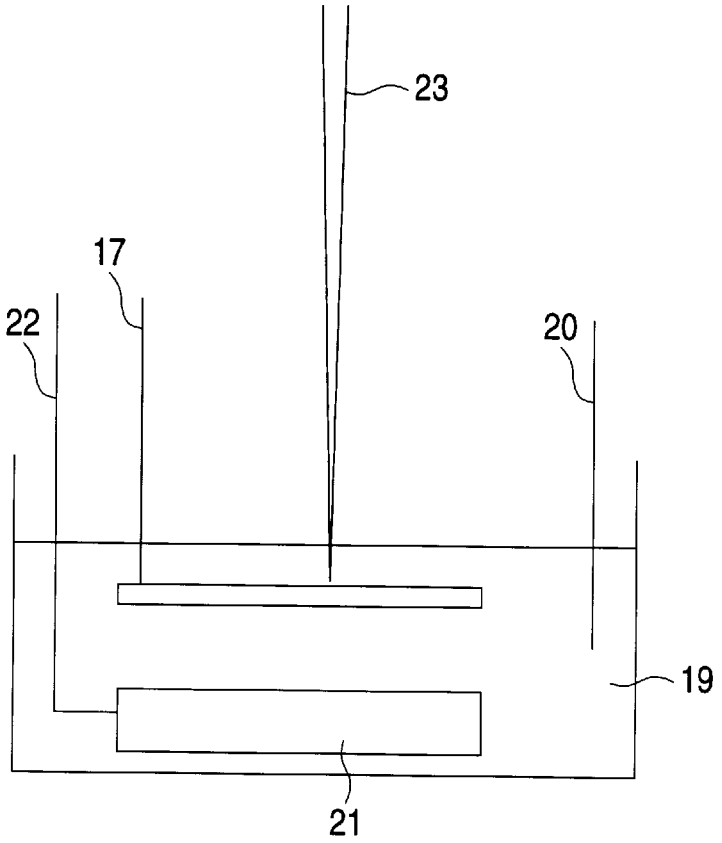
FIG. 7 is a diagram illustrating a light-irradiating apparatus for image formation.

In the same manner as in Example 5, an n-Si substrate was used as the working electrode 17 with respect to saturated calomel electrode 20, and a Pt electrode 21 was used as the counter electrode in an aqueous solution 19 containing 0.06 M of pyrrole and 0.02 M of Rose Bengal in the apparatus shown in FIG. 7. The n-Si working electrode 17 was irradiated in the aqueous solution with laser beam 23 externally from a galvanoscanner as shown in FIG. 9 with the potential of the n-Si working electrode set at +0.4 V vs. SCE to write an image pattern while varying the applied voltage vs. SCE at the n-Si working electrode. As a result, an image with a density gradation according to the applied vias voltage was formed. The n-Si substrate on which the polypyrrole film having an image was formed was washed with pure water, and then brought into contact with a sheet of paper impregnated with an alkaline buffer solution having a pH value of 10. As a result, the Rose Bengal dye was attached to the paper so that an image having a density gradation was transferred to the paper.

EXAMPLE 7

Figure 8:
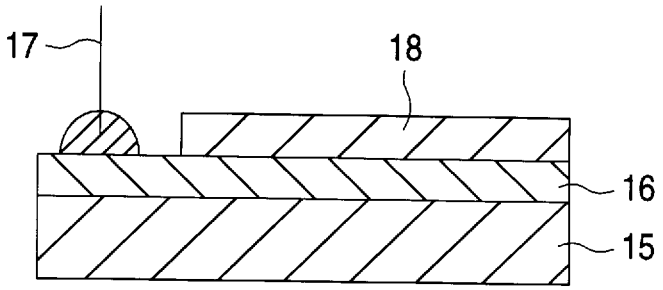

As shown in FIG. 8, a transparent electrode (ITO) 16 was formed on a borosilicate glass 15. A perylene derivative (benzimidazole perylene) 18 as an n-type organic semiconductor was then deposited on the transparent electrode 16 to obtain a benzimidazole perylene film having a thickness of 80 nm. The transparent electrode having the film was used as an n-type semiconductor substrate. In the same manner as in Example 5, the ITO electrode 16 was used as the working electrode with respect to saturated calomel electrode 20, and a Pt electrode 21 was used as the counter electrode in an aqueous solution 19 containing 0.06 M of pyrrole and 0.02 M of Rose Bengal in the apparatus shown in FIG. 7. The n-type semiconductor substrate was irradiated with laser beam 23 externally from a galvanoscanner as shown in FIG. 9 with the n-Si working electrode set at +0.2 V vs. SCE in the aqueous solution to write an image pattern. As a result, a polypyrrole film containing Rose Bengal was formed on the benzimidazole perylene film 18 only on the area irradiated with light. Thus, an image having a density gradation according to the intensity of irradiated light and irradiation time was formed. The benzimidazole perylene substrate (15, 16, 18) on which a polypyrrole film having an image had been formed was washed with pure water, and then brought into contact with a sheet of paper impregnated with an alkaline buffer solution having a pH value of 10. As a result, the Rose Bengal dye was attached to the paper so that an image having a density gradation was transferred to the paper.

The image forming member of the present invention comprises a conducting polymer film capable of being doped with or undoped of an ionic dye molecule, formed on a substrate comprising an organic or inorganic semiconductor. The conducting polymer film is doped with or undoped of an ionic dye molecule whereby an image is formed on the conducting polymer film.

According to the image forming process of the present invention, a conducting polymer film is formed only on a substrate in the area irradiated with light according to the intensity of irradiated light using a semiconductor capable of generating photovoltaic force, whereby an image is formed.

Further, according to the marking process and apparatus of the present invention, an image pattern can be transferred to a recording medium such as paper to perform marking.

While the invention has been described in detail and with reference to specific embodiments thereof, it will be apparent to one skilled in the art that various changes and modifications can be made therein without departing from the spirit and scope thereof.

What is claimed is:

1. An image forming member which comprises:

a substrate comprising an organic or inorganic semiconductor; and a conducting polymer film comprising an ionic dye molecule, wherein said conducting polymer film is formed on the substrate, which is capable of being doped with or undoped of said ionic dye molecule.

2. An image forming process comprising irradiating a substrate comprising an organic or inorganic semiconductor with light to generate photovoltaic force or photoelectric current so that a conducting polymer film formed on the substrate is doped with or undoped of an ionic dye molecule to form an image.

3. The image forming process according to claim 2, wherein the process comprises forming a conducting polymer film doped with an ionic dye molecule on a substrate comprising an organic or inorganic semiconductor by irradiating the substrate with light to form an image on the substrate.

4. The image forming process according to claim 3, wherein the substrate comprising an n-type semiconductor and the ionic dye molecule is an anionic dye molecule.

5. The image forming process according to claim 3, wherein the substrate comprising a p-type semiconductor and the ionic dye molecule is a cationic dye molecule.

6.The image forming process according to claim 2, wherein the process comprises doping a conducting polymer film on a substrate comprising an organic or inorganic semiconductor with an ionic dye molecule by irradiating the substrate with light to form an image on the conducting polymer film.

7. The image forming process according to claim 6, wherein the substrate comprising an n-type semiconductor and the ionic dye molecule is an anionic dye molecule.

8. The image forming process according to claim 6, wherein the substrate comprising a p-type semiconductor and the ionic dye molecule is a cationic dye molecule.

9. The image forming process according to claim 2, wherein the process comprises undoping a conducting polymer film containing an ionic dye molecule on a substrate comprising an organic or inorganic semiconductor of the ionic dye molecule by irradiating the substrate with light to form an image on the conducting polymer film.

10. The image forming process according to claim 9, wherein the conducting polymer film is formed entirely on the substrate by electrochemical polymerization using the substrate as an electrode.

11. The image forming process according to claim 10, wherein the substrate comprises a p-type semiconductor and the ionic dye molecule is an anionic dye molecule.

12. The image forming process according to claim 10, wherein the substrate comprises an n-type semiconductor and the ionic dye molecule is a cationic dye molecule.

13. The image forming process according to claim 10, wherein the process further comprises electrochemically undoping the conducting polymer film of the ionic dye molecule forming the image while irradiating the substrate with light to transfer the image to a recording medium.

14. The image forming process according to claim 2, wherein the quantity of electric charge required for doping or undoping is controlled to adjust the content of the ionic dye molecule in the conducting polymer film so that a graduated image is formed on the conducting polymer.

15. The image forming process according to claim 14, wherein the quantity of the electric charge is controlled by adjusting film forming time.

16. The image forming process according to claim 14 wherein the quantity of the electric charge is controlled by adjusting vias voltage applied.

17. The image forming process according to claim 14, wherein the quantity of the electric charge is controlled by adjusting irradiation time.

18. The image forming process according to claim 14, wherein the quantity of the electric charge is controlled by adjusting intensity of the irradiated light.

19. The image forming process according to claim 2, wherein the process further comprises electrochemically undoping the conducting polymer film of the ionic dye molecule forming the image to transfer the image to a recording medium.

* * * * *